US007559829B2

(12) United States Patent
Stephane et al.

(10) Patent No.: US 7,559,829 B2
(45) Date of Patent: Jul. 14, 2009

(54) TOOL FOR SURFACING AN OPTICAL SURFACE

(75) Inventors: Jean Stephane, Charenton le Pont (FR); Laurent Marcepoil, Charenton le Pont (FR); Patrick Herbin, Charenton le Pont (FR); Jean-Marc Padiou, Charenton le Pont (FR)

(73) Assignee: Essilor International (Compagnie Generale d'Optique), Charenton le Pont (FR)

( * ) Notice: Subject to any disclaimer, the term of this patent is extended or adjusted under 35 U.S.C. 154(b) by 163 days.

(21) Appl. No.: 11/914,329

(22) PCT Filed: Apr. 18, 2007

(86) PCT No.: PCT/FR2007/000650

§ 371 (c)(1),
(2), (4) Date: Nov. 13, 2007

(87) PCT Pub. No.: WO2007/128894

PCT Pub. Date: Nov. 15, 2007

(65) Prior Publication Data

US 2008/0171502 A1 Jul. 17, 2008

(30) Foreign Application Priority Data

Apr. 27, 2006 (FR) ..... 06 03796

(51) Int. Cl.
*B24D 17/00* (2006.01)

(52) U.S. Cl. ..... 451/512; 451/514; 451/490; 451/921

(58) Field of Classification Search ..... 451/42, 451/285, 508, 512, 514, 526, 530, 533, 539, 451/490, 921

See application file for complete search history.

(56) References Cited

U.S. PATENT DOCUMENTS

| | | | | | |
|---|---|---|---|---|---|
| 1,665,292 | A * | 4/1928 | Anderson et al. | ..... | 15/230.18 |
| 1,701,669 | A * | 2/1929 | Favre | ..... | 451/342 |
| 3,395,417 | A * | 8/1968 | Matouka | ..... | 15/230 |
| 3,653,857 | A * | 4/1972 | Field | ..... | 451/490 |
| 4,287,685 | A * | 9/1981 | Marton | ..... | 451/359 |
| 5,403,231 | A * | 4/1995 | Duckworth | ..... | 451/344 |
| 7,033,261 | B2 * | 4/2006 | Huguet | ..... | 451/490 |
| 7,217,176 | B2 * | 5/2007 | Schneider et al. | ..... | 451/283 |
| 7,223,164 | B2 * | 5/2007 | Bernard et al. | ..... | 451/490 |
| 2004/0072515 | A1 * | 4/2004 | Miyahara et al. | ..... | 451/285 |
| 2005/0101235 | A1 | 5/2005 | Huguet | | |
| 2006/0154581 | A1 | 7/2006 | Bernard et al. | | |

FOREIGN PATENT DOCUMENTS

| | | |
|---|---|---|
| EP | 1 291 134 | 3/2003 |
| FR | 2 857 610 | 1/2005 |
| GB | 1011741 | 12/1965 |
| WO | WO 03/059572 | 7/2003 |

* cited by examiner

*Primary Examiner*—Eileen P. Morgan
(74) *Attorney, Agent, or Firm*—Young & Thompson

(57) ABSTRACT

This tool includes:

a rigid support (104) having a transverse end surface (113);

an elastically compressible interface that is pressed against and covers the end surface;

a flexible pad adapted to be pressed against the optical surface, itself pressed against and covering the interface on the opposite side of and in line with the end surface (113);

spring return element (115) connecting the support (104) to a peripheral portion of the flexible pad situated transversely beyond the end surface (113); and a flexible flange (131) that is part of a base (130) to which the rigid support (104), which is surrounded by the flange (131), also belongs.

20 Claims, 6 Drawing Sheets

TOOL FOR SURFACING AN OPTICAL SURFACE

FIELD OF THE INVENTION

The invention relates to surfacing optical surfaces.

By surfacing is meant any operation aiming to modify the surface state of a previously fashioned optical surface. This means in particular operations of polishing, grinding or frosting aiming to modify (reduce or increase) the roughness of the optical surface and/or to reduce the unevenness thereof.

TECHNOLOGICAL BACKGROUND

There is already known a tool for surfacing an optical surface that includes a rigid support having a transverse end surface, an elastically compressible interface that is pressed against and covers said end surface, and a flexible pad adapted to be pressed against the optical surface and that is pressed against and covers at least part of the interface on the opposite side of and in line with said end surface.

To reduce the roughness of the optical surface, the tool is brought into contact with the latter, maintaining sufficient pressure of the tool on it for the pad to espouse the shape of the optical surface through deformation of the interface.

While spraying the optical surface with a fluid, it is driven in rotation relative to the tool (or vice-versa) and it is swept by means of the latter.

It is generally the optical surface that is driven in rotation, its rubbing against the tool being sufficient to drive the latter in rotation conjointly.

The surfacing operation necessitates an abrasive which can be contained in the pad or in the fluid.

During surfacing, the elastically compressible interface compensates the curvature difference between the end surface of the support of the tool and the optical surface, so that the same tool is adapted to a range of optical surfaces with different curvatures and shapes.

French patent application 2 834 662, which corresponds to American patent application 2005/0101235, proposes a surfacing tool of this kind which, whilst being adapted to a sufficiently vast range of optical surfaces, in terms of curvatures (convexity, concavity) and shapes (spherical, toric, aspherical, progressive or any combination of the latter, or more generally "freeform"), has good stability during surfacing and provides reliable and fast surfacing of good quality.

One embodiment of the tool proposed by the above document is described hereinafter with reference to FIGS. 1 to 3 of the appended drawings, in which:

FIG. 1 is an exploded perspective view of this tool and an ophthalmic lens having an optical surface to be surfaced;

FIG. 2 is a view in section of this tool shown assembled, during surfacing of the optical surface of the lens from FIG. 1; and FIG. 3 is a diagrammatic plan view representing this ophthalmic lens during surfacing by means of this tool, which is represented while sweeping the optical surface in two positions, one of which is shown in dashed line.

In FIG. 1 there is represented a tool 1 for surfacing an optical surface 2, in this instance one of the faces of an ophthalmic lens 3. In FIG. 1, as in FIG. 2, the optical surface 2 concerned is represented as concave, but it could equally well be convex.

The tool 1 is formed of a stack of at least three parts, namely a rigid part 4, an elastically compressible part 5, and a flexible part 6 which, hereinafter, will respectively be called the support, the interface and the pad.

As is apparent in FIG. 1 in particular, the support 4 includes two jaws, namely a lower jaw 7 and an upper jaw 8 adapted to be superposed and nested one in the other by way of a peg 9 projecting from one face 10 of the upper jaw 8, adapted to be accommodated in a complementary hole 11 formed facing it in a face 12 of the lower jaw 7.

As can be seen in FIG. 1, the support 4 is globally a cylinder with circular symmetry and has an axis of symmetry X that defines a longitudinal direction.

The normal to the optical surface 2 at the point of intersection of the axis of symmetry X of the tool 1 therewith is denoted n.

On the side opposite its face 12 in which the hole 11 is formed, the lower jaw 7 has an end surface 13 extended substantially transversely, against which the interface 5 is pressed, covering it.

The pad 6 is pressed against the interface 5 on the other side of the latter relative to the support 4.

More precisely, the pad 6 covers at least part of the interface 5 on the opposite side to and in line with the end surface 13.

The rubbing of the pad 6 against the optical surface 2 ensures, by means of an abrasive contained in the spray fluid or incorporated into the pad 6 itself, superficial removal of material on the optical surface 2 in order to modify the surface state, as will emerge hereinafter.

The pad has a central portion 6*a* that is in line with the end surface 13 and a peripheral portion 14 which is located transversely beyond the end surface 13.

This peripheral portion 14 is connected to the support 4 by spring return means 15.

The peripheral portion 14 is in line with the central portion 6*a* and, when at rest, is substantially coplanar with it.

In the example shown in FIGS. 1 and 2, the pad 6 is in one piece, the peripheral portion 14 being connected to the central portion 6*a*, so that they in fact form a single part.

In an embodiment represented in bold line in FIG. 1, the pad 6 is flower-shaped and thus comprises a plurality of petals 14*b* which, projecting transversely from the central portion 6*a*, form the peripheral portion 14 of the pad 6 and each extend transversely beyond the end surface 13.

In a variant represented in chain-dotted line in FIG. 1, the peripheral portion 14 is in the shape of a ring 14*a* that surrounds the central portion 6*a*.

In this case, in the absence of any load, the pad 6, if it is in one piece, is in the shape of a disc of material whose thickness is small compared to its diameter, as shown in FIG. 1, the peripheral portion 14, 14*a* thus forming a flange relative to the end surface 13.

The return means 15, which will be described later, can be disposed directly between the support 4 and the peripheral portion 14 of the pad 6, i.e. in practice the flange 14*a* or the petals 14*b*.

The interface 5 has not only a central portion 5*a* that is located in line with the end surface 13 but also a peripheral portion 16 that is transversely beyond the end surface 13.

This peripheral portion 16 is in line with the central portion 5*a* and, in the absence of any load, is in the shape of a ring that surrounds the central portion 5*a*, for example, and is in fact disposed between the peripheral portion 14 of the pad 6 and the return means 15.

As can be seen in FIGS. 1 and 2, the interface 5 is in one piece, its central portion 5*a* and peripheral portion 16 being in fact connected to form together a single part, the peripheral portion 16 forming a flange relative to the end surface 13.

Thus in the absence of any load the one-piece interface 5 is in the shape of a disc of material whose thickness is small compared to its transverse dimension (i.e. its diameter), for example.

When the interface 5 and the pad 6 are both in one piece, they have comparable transverse dimensions. In particular, when each is in the form of a disc of material, for constructive convenience they are preferably the same diameter. However, there could equally be provision for using a pad of different diameter to that of the interface, in particular a greater diameter in order to attenuate edge effects of the tool on the worked surface.

Moreover, for reasons that will become apparent hereinafter, a deformable ring 17 is provided, disposed between the peripheral portion 16 of the interface 5 and the return means 15.

In practice, this ring 17 is fixed to the peripheral portion 16 on the other side of the latter to the pad 6, i.e. on the same side as the support 4, and so that the latter is surrounded by the ring 17.

This ring 17 preferably has a circular longitudinal section, but it could equally have a section of more complex shape, in particular oblong, polygonal, rectangular or square shape. Moreover, it is disposed on the peripheral portion 16 concentrically with the support 4.

The return means 15 is described next.

It comprises at least one elastically flexible leaf 18 that projects transversely from the support 4 and is connected, on the one hand, rigidly, to the support 4 by a first end 18*a* and, on the other hand, to the peripheral portion 14 of the pad 6 by a second end 18*b*, called the free end, opposite the first end 18*a*.

As a result, the effect of a force exerted longitudinally on the peripheral portion 14 in line with this leaf 18 is that the latter is deformed, exerting on the peripheral portion 14 a reaction opposite to said force.

In practice, the return means 15 include a plurality of such leaves 18, distributed uniformly at the periphery of the support 4, to act on the whole of the peripheral portion 14 of the pad 6.

The return means 15 in fact take the form of a star-shaped part 19 fixed rigidly to the support 4.

The star-shaped part 19 has a central portion 20 from which project a plurality of branches 18 each forming an elastically flexible leaf extended radially in a transverse plane.

For fixing the star-shaped part 19 to the support 4, its central portion 20 is in practice clamped between the jaws 7, 8 of the support 4, it being centered by means of a through-hole 21 produced at its center, through which passes the peg 9 of the upper jaw 8, the assembly being held by fixing means such as screws which, passing through the upper jaw 8 and the central portion 20 of the star-shaped part 19, are engaged in the lower jaw 7.

If, as in an embodiment previously described, the one-piece pad 6 has a plurality of petals 14*b*, there are provided on the star-shaped part 19 as many branches 18 as there are petals 14*b*, the star-shaped part 19 being oriented so that each branch 18 extends in line with a petal 14*b*. Thus if the pad 6 has seven petals 14*b*, the star-shaped part 19 has seven branches 18 each adapted to provide the return spring force for one petal 14*b*.

The ring 17 is fixed to the interface 5, which fixing can be provided by any means, although gluing is preferred, in particular for its simplicity.

In the embodiment represented, the diameters of the interface 5, the pad 6 and the star-shaped part 19 have a value at least twice that of the diameter of the support 4.

Moreover, when it is a question of surfacing an ophthalmic lens, the diameters of the interface 5 and the pad 6 are chosen to be substantially equal to the diameter of the lens 3, with the result that the diameter of the support 4 is much less than the diameter of the lens 3.

The use of the tool 1 is illustrated in FIGS. 2 and 3.

In this instance it is a question of surfacing or grinding an aspherical convex face 2 of an ophthalmic lens.

The lens 3 is mounted on a rotary support (not shown) by means of which it is driven in rotation about a fixed axis Y.

The tool 1 is pressed against this face 2 with sufficient force for the pad 6 to espouse its shape. Here the tool 1 is free to rotate and off-center relative to the optical surface 2. Forced driving of the tool in rotation by appropriate means can nevertheless be provided.

The relative rubbing of the optical surface 2 and the pad 6 is sufficient to drive the tool 1 in rotation in the same direction as the lens 3 about an axis substantially coincident with the axis of symmetry X of the support 4.

The optical surface 2 is sprayed with a non-abrasive or abrasive spray fluid according to whether the pad exercises this function itself or not.

In order to sweep the whole of the optical surface 2, the tool 1 is moved during surfacing along a radial trajectory, the point of intersection of the rotation axis X of the tool 1 with the optical surface 2 effecting a to and fro movement between two turnaround points, namely an exterior turnaround point A and an interior turnaround point B both situated at a distance from the rotation axis Y of the lens 3.

The central portion 6*a* of the pad 6 is deformed to espouse the shape of the optical surface 2 thanks to the compressibility of the central portion 5*a* of the interface 5.

As for the peripheral portion 14 of the pad 6, it is deformed to espouse the shape of the optical surface 2 thanks to the deformation of the flexible leaves 18.

Given the rigidity of the support 4, material is removed for the most part in line with the end surface 13, i.e. this removal of material is effected essentially by the central portion 6*a* of the pad 6.

As for the peripheral portions 14 of the pad 6 and 16 of the interface 5, they have essentially a stabilizing role, on the one hand thanks to the increased span or seat of the tool 1 compared to a standard tool the pad and the interface whereof would be limited to the central portions 5*a*, 6*a* and, on the other hand, thanks to the return means 15 that maintain a permanent contact between the peripheral portion 14 of the pad 6 and the optical surface 2.

The deformable ring 17 smoothes the distribution of the load exerted on the peripheral perimeter of the interface 5 and therefore on the pad 6 by the leaves 18.

As a result of this, whatever the location of the tool 1 on the optical surface 2 and whatever its rotation speed, its rotation axis X is always colinear or substantially colinear with the normal n to the optical surface 2, the orientation of the tool 1 therefore being the optimum at all times.

In the embodiment shown in FIGS. 1 and 2, the end surface 13 of the support 4 is flat.

The tool 1 is therefore adapted to surface a certain range of optical surfaces 2 with different curvatures.

In order to modify the adaptability of the tool 1, it is possible to preload the return means 15 by twisting the flexible leaves 18 so that they are already flexed when no load is applied, one way or the other.

If when no load is applied the leaves 18 are straight or flexed away from the end surface 13, the tool 1 is intended for concave optical surfaces 2, whereas if when no load is applied the leaves 18 are flexed on the same side as the end surface 13 the tool 1 is intended for convex optical surfaces 2.

In a first variant that is not shown, the end surface 13 of the support 4 is convex, the tool 1 thus being intended for optical surfaces 2 having a more pronounced concavity.

In a second variant that is not shown, the end surface 13 of the support 4 is in contrast concave, the tool 1 thus being intended for optical surfaces 2 of more pronounced convexity.

Of course, it is possible to combine the concave or convex implementation of the end surface 13 with the preloading of the return means 15 as described hereinabove.

French patent application 2 857 610, which corresponds to the international application WO 2005/007340, proposes that the spring return means, rather than taking the form of a star-shaped part such as the part 19 shown in FIGS. 1 and 2, have a continuous peripheral portion cooperating in bearing fashion with the peripheral portion of the pad like the pad 6, directly or through the intermediary of the only interface such as the interface 5 (there is no deformable ring like the ring 17), the return spring means including, in addition to the continuous peripheral part, a flat or curved flange fixed rigidly on the inside to the support like the support 4, this flange being formed by a perforated or solid wall.

The continuous character of the peripheral portion of these return means increases the regularity of the surfacing effected by the tool.

OBJECT OF THE INVENTION

The invention is aimed at a surfacing tool of the same kind, but in which the regularity of surfacing is further improved together with its qualities of simplicity, convenience and economy.

To this end the invention proposes a tool for surfacing an optical surface, including:

- a rigid support having a transverse end surface;
- an elastically compressible interface that is pressed against and covers said end surface;
- a flexible pad adapted to be pressed against the optical surface that is pressed against and covers at least part of the interface on the side opposite and in line with said end surface, said pad having a portion called the central portion that is located in line with said end surface and a portion called the peripheral portion that is located transversely beyond said end surface; and
- spring return means connecting this peripheral portion to the support, the combination of said peripheral portion and the return means forming means for stabilizing the tool during surfacing, said tool being adapted to effect surfacing essentially in the region of said central portion;

characterized in that said rigid support is part of a base including a flexible flange surrounding said support, said elastically compressible interface being pressed against and covering an end surface of said flange situated on the same side as said end surface.

Thanks to the flange, the area of contact between the interface and the rest of the tool is particularly large, which ensures a uniform distribution of the pressure exerted on the surface to be worked.

The tool according to the invention can therefore effect surfacing offering a high quality of appearance.

Moreover, this greater area of contact facilitates coupling the interface to the rigid support, in particular by gluing.

According to features preferred for the quality of the results obtained or for reasons of simplicity or convenience of fabrication or use:

- the end surface of the flange is flush with said end surface of said support;
- said flange is subdivided into petals;
- the rigid support includes a cavity to receive the head of a surfacing machine spindle;
- said cavity has a spherical portion bordered by an annular rib;
- the rigid support has in a lateral wall a groove to receive a rib of said spring return means;
- said spring return means is formed by a star-shaped part each branch whereof has on the side of its free end and on the side that faces toward said base a cusp;
- each of said cusps has, on the external side, a surface conformed as a portion of a torus, thanks to which said star-shaped part is adapted to receive said deformable ring;
- said base is molded in one piece in plastic material;
- said spring return means are formed by a star-shaped part molded in one piece in plastic material; and/or
- said base is molded in one piece in plastic material; said spring return means is formed by a star-shaped part molded in one piece in plastic material; and the plastic material in which said base is made is different from the plastic material in which said star-shaped part is made.

BRIEF DESCRIPTION OF THE DRAWINGS

The disclosure of the invention continues next with a detailed description of preferred embodiments given hereinafter by way of nonlimiting illustration and with reference to the appended drawings. In the latter.

DETAILED DESCRIPTION OF ONE EMBODIMENT

Figure 1:
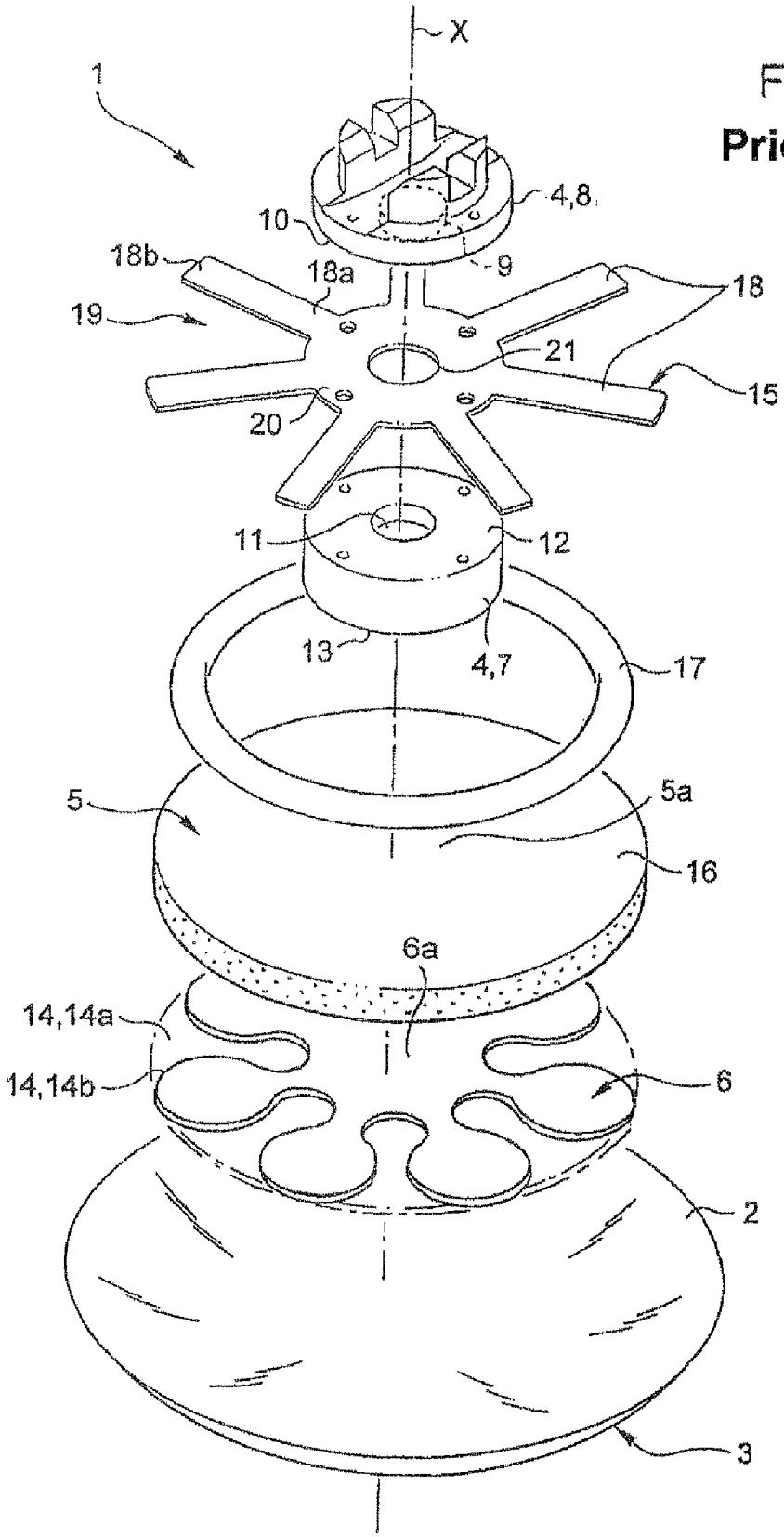
Fig.1 Prior Art
FIGS. 1-3 are various views of a conventional tool.

The same reference numbers as for the tool 1 have been used hereinafter for the tool according to the invention, but increased by 100.

Generally speaking, the tool 101 is arranged like the tool 1, with:

- a rigid support 104 having a transverse end surface 113;
- an elastically compressible interface 105 (FIG. 7) that is pressed against and covers the end surface 113;
- a flexible pad 106 (FIG. 7) adapted to be pressed against the optical surface such as 2 of a lens such as 3 and which is pressed against and covers at least part of the interface 105 on the opposite side to and in line with the end surface 113, the pad 106 having a central portion that is in line with the end surface 113 and a peripheral portion that is transversely beyond the end surface 113; and
- spring return means 115, here formed by a star-shaped part 119, connecting the peripheral portion of the pad 106 to the support 104, which is surrounded transversely by a deformable ring 117 disposed between the peripheral portion of the interface 105 and the return means 115, the combination of the peripheral portion of the pad 106 and the return means forming means 101 for stabilizing the tool during surfacing, the tool 101 being adapted to effect surfacing essentially in the region of the central portion of the pad 106.

According to the invention, the support 104 is part of a base 130 that has a flexible peripheral portion 131 located transversely beyond the rigid support 104, which is centrally disposed.

The peripheral portion 131 forms overall a flexible flange having an outside diameter (greater diameter) similar to the outside diameter of the interface 105 and the pad 106.

The inside diameter (smaller diameter) of the flexible flange 131 corresponds to the outside diameter of the support 104, the flange 131 projecting from the lateral wall of the support 104.

Figure 4:
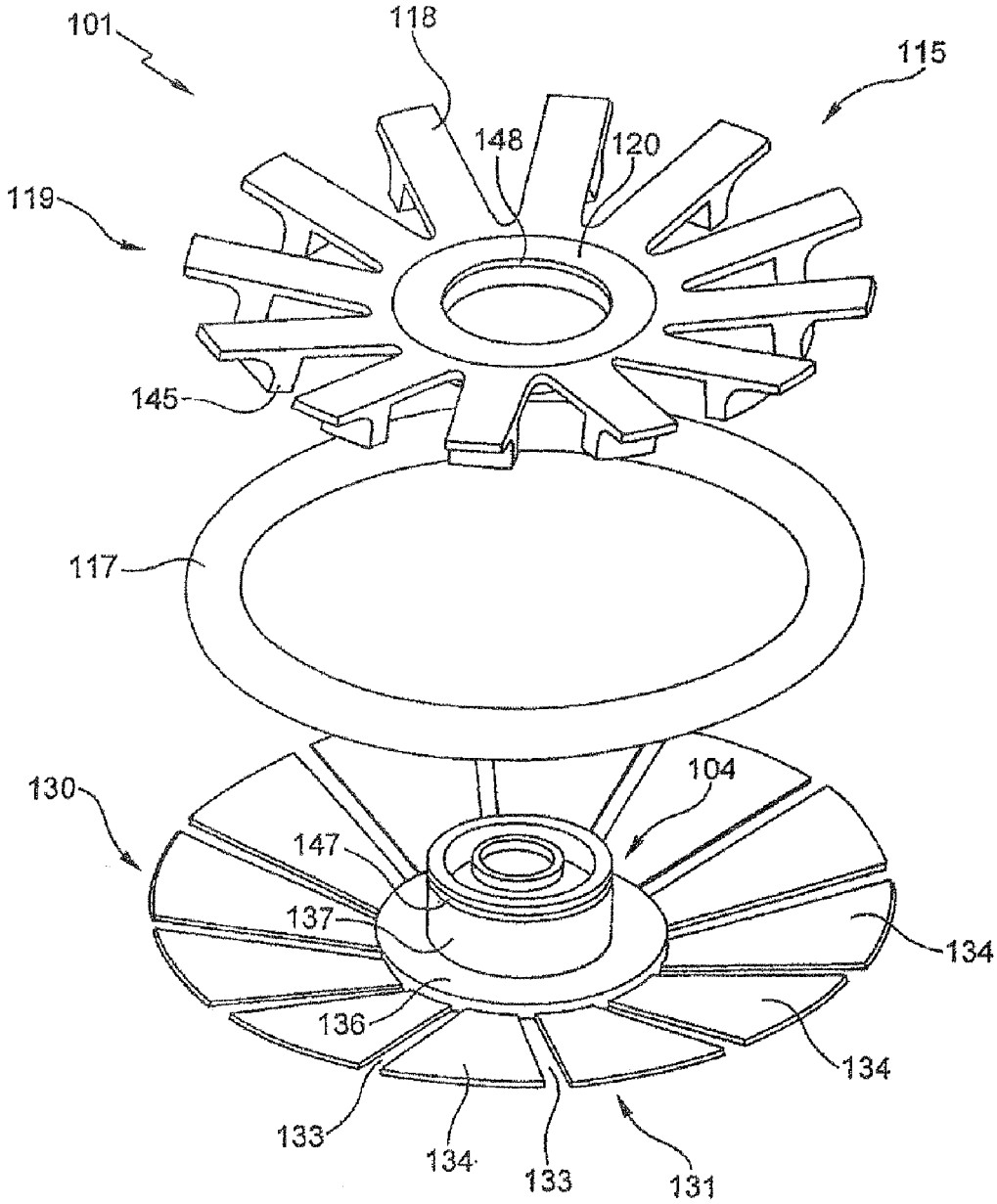
FIG. 4 is an exploded perspective view of a portion of the tool according to the invention, and more precisely the base, the deformable ring and the star-shaped part.
Figure 5:
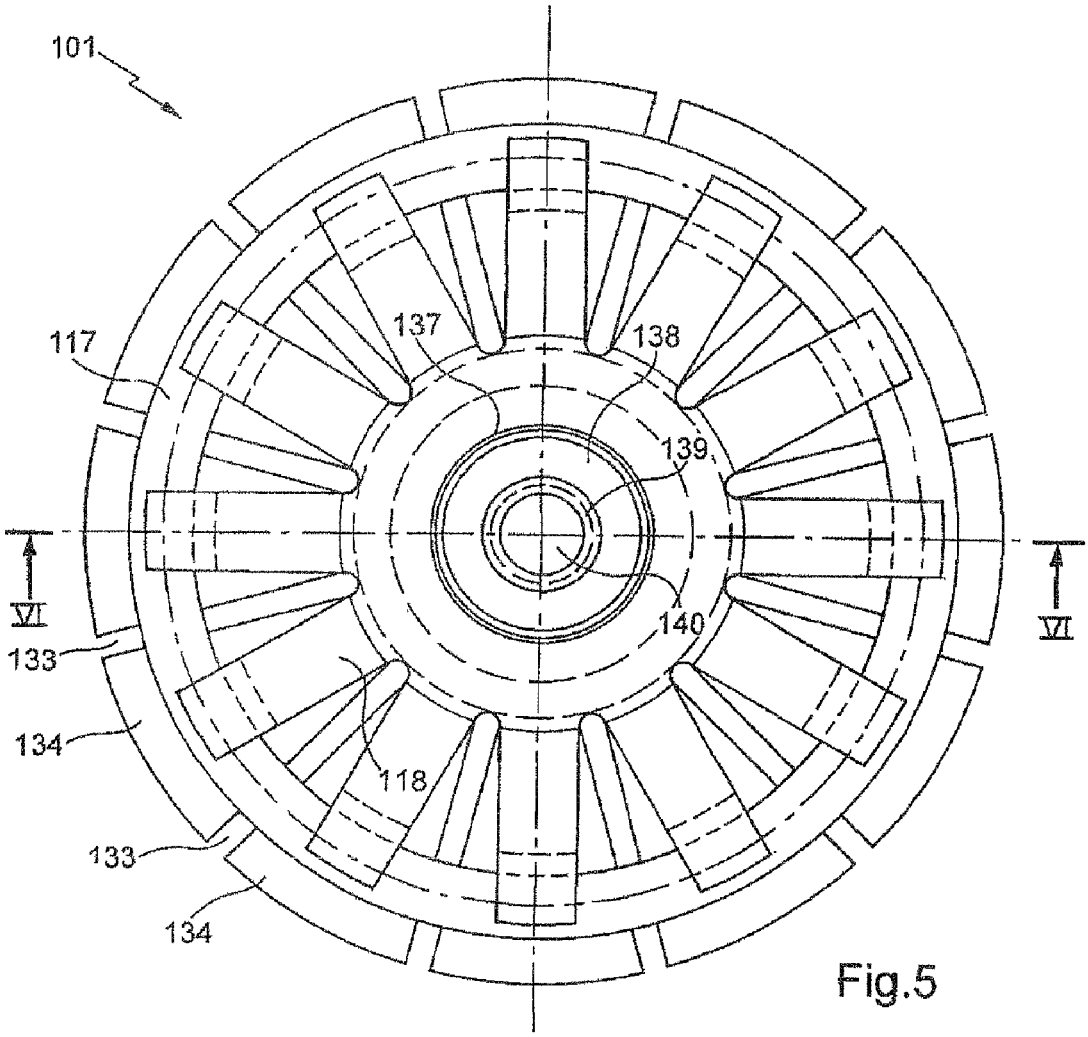
FIG. 5 is a plan view representing this portion of the tool according to the invention in the assembled state.
Figure 6:
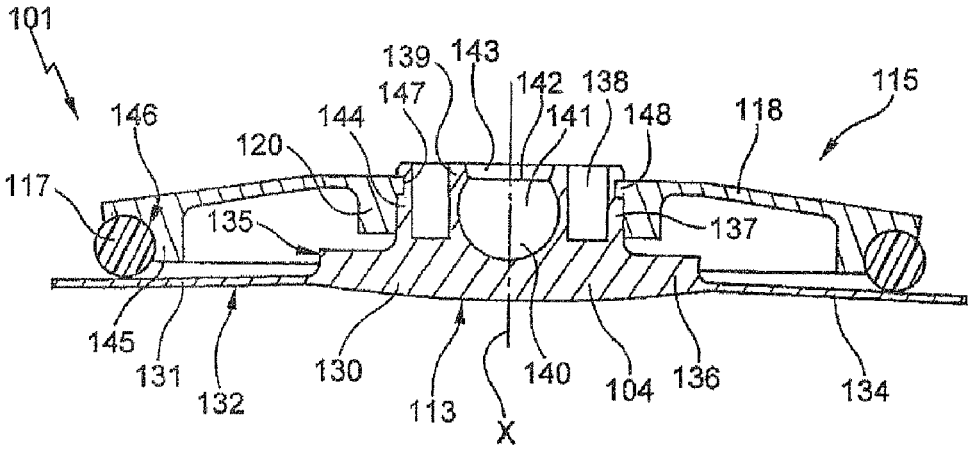
FIG. 6 is the view in elevation-section designated VI-VI in FIG. 5.

In the example shown in FIGS. 4 to 6, the support 104 and the flexible peripheral flange 131 are molded in one piece from plastic material, the support 104 being solid at least in the vicinity of the surface 113 in order to have the required stiffness whereas the flange 131 has a thin wall in order to be flexible.

In the preferred embodiment shown in FIGS. 4 to 6, the flange 131 has twelve equi-angularly distributed and radially oriented slots 133, with the result that the flange 131 is subdivided into twelve petals 134 each of which has the overall shape of a truncated angular sector.

The subdivision of the flange 131 into petals makes the flange flexible so that it can conform to different curvatures of surfaces to be polished.

The end surface 113 of the support 104 is flush with the surface 132 of the flange 131 situated on the same side.

The fact that the support 104 and the flange 131 are made in one piece reduces the effects of the edge of the end surface 113 marking the surface to be worked, with the result that the tool 101 can effect surfacing offering a high quality appearance.

Because of the difference in thickness between the flange 131 and the support 104, on the side opposite the surfaces 132 and 113 there is a shoulder 135 at the junction between the flange 131 and the support 104.

Generally speaking, the support 104 has a hat-shaped external contour with a proximal portion 137 that has an outside diameter smaller than the distal portion 136 of which the end surface 113 and the shoulder 135 form part.

The proximal portion 137 serves to connect the support 104, and more generally the base 130, on the one hand, to the spring return means 115, here formed by the star-shaped part 119, and, on the other hand, to the spindle of the surfacing machine enabling the tool 101 to cooperate with an optical surface such as 2 in the manner explained hereinabove with reference to FIGS. 2 and 3.

The proximal portion 137 has an annular recess 138 opening onto the side opposite the end surface 113 and extending axially in the portion 137 to the vicinity of the portion 136.

The inside lateral surface of the recess 138 delimits an annular bush 139 for receiving the head of the spindle of a surfacing machine.

To do this, the bush 139 features a cavity 140 to receive the spindle head. The cavity 140 has a spherical portion 141 with the global shape of three-quarters of a sphere, an annular rib 142 and a frustoconical portion 143, the annular rib 142 being disposed between the portions 141 and 143.

The spindle head designed to be received in the cavity 140 has a part-spherical end shaped like the portion 141 and a cylindrical portion of smaller diameter than the rib 142.

The bush 139 and the spindle of the machine are assembled together by a simple clipping action, the wall of the bush 139 being sufficiently thin, thanks to the recess 138, to be able to deform so that the spherical portion of the spindle head lodges in the portion 141.

When the spindle head is engaged in the cavity 140, the tool 101 cooperates with the spindle in the manner of a ball-joint.

It will be noted that the center of the spherical portion 141 is particularly close to the end surface 113, which enables the tool 101 to assume an optimum orientation relative to the surface such as 2 with which the tool 101 must cooperate.

An annular bush 144 is delimited by the lateral wall of the proximal portion 137 and by the outside lateral wall of the recess 138.

A groove 147 is formed in the lateral wall of the portion 137 to receive a rib 148 on the star-shaped part 119 forming the spring return means 115.

The annular bush 144 can be deformed to enable the rib 148 to be placed in the groove 147 thanks to the fact that the wall of the bush 137 is relatively thin and the annular recess 138 offers the necessary clearance.

The rib 148 on the star-shaped part 119 projects into the bore in the central portion 120 of this part, this bore having a diameter corresponding to that of the lateral surface of the distal portion 137 of the support 104.

When the central portion 120 of the star-shaped part 119 is in place on the support 104, these two parts can turn the one relative to the other about their common axis X.

In FIG. 5, the branches 118 of the star-shaped part 119 are each centered angularly relative to a respective petal 134 of the flange 131, but this relative positioning can be different.

Each of the branches 118 of the part 119 has near its free end and on the side facing toward the base 130 a cusp 145 that has, on the outside, a surface 146 conformed as a portion of a torus centered on the central axis of the part 119, and therefore more generally of the tool 101.

The surfaces 146 of the various cusps 145 are in corresponding relationship with each other and with the outside surface of the deformable ring 117.

More precisely, the ring 117 must be slightly stretched so that it can take its place against the cusps 145, in the manner shown in FIGS. 5 and 6, the elasticity of the ring 117 holding it pressed against the surfaces 146.

As seen in FIG. 6 in particular, the ring 117, when it is in place, is sandwiched between the spring return means 115 (star-shaped part 119) and the flexible flange 131.

As indicated hereinabove, the diameter of the interface 105 and the pad 106 corresponds to the outside diameter of the flange 131.

The connection between the interface 105 and the base 130 is effected by means of a double-sided adhesive 150 disposed between the interface 105 and the surfaces 113 and 132 of the base 130.

In the example shown, the elastically compressible interface 105 is a foam having a thickness of the order of 9 mm with a shiny skin that is situated on the same side as the pad 106.

On the side opposite the skin, i.e. on the same side as the double-sided adhesive 150, is heat-welded a polyester (PET) film 151, having a thickness of 23 micrometers, for example.

The connection between the elastically compressible interface 105 and the flexible pad 106 is effected by means of a layer 152 of mastic, here a layer 0.5 mm thick.

Figure 7:
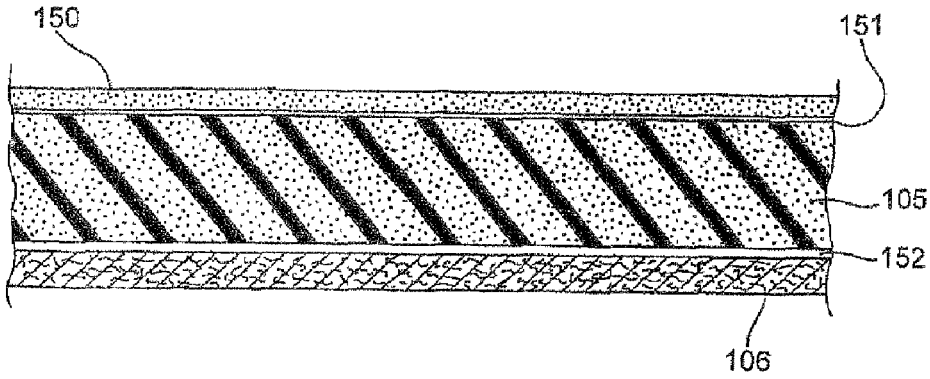
FIG. 7 is a diagrammatic view in section of another portion of the tool according to the invention, including the elastically compressible interface and the flexible pad.

Still in the case of the example shown in FIG. 7, the flexible pad 106 has a thickness of the order of 1 mm and the double-sided adhesive 150 has a thickness of the order of 0.32 mm.

The diameter of the interface 105 and the pad 106 is of the order of 55 mm.

The star-shaped part 119 and the base 130 are each injection-molded in one piece from plastic material.

In the example shown, the base 130, which must at one and the same time be rigid in the vicinity of the end surface 113 and flexible in the region of the flange 131 and the annular bushes 139 and 141 to enable clipping, at the same time as offering good resistance to wear for the cooperation with the spindle head, is in polypropylene (PP) or high-density polyethylene (for example PEHD 1000).

To have the required elasticity, the star-shaped part 119 is preferably in polyoxymethylene (POM), or even in polyamide (PA) in order to have a modulus of elasticity between 1500 and 4000 $N/mm^2$.

Thus the star-shaped part 119 and the base 130 are preferably made in different materials, since they must address different physical constraints, the star-shaped part forming the spring return means having to have good spring return characteristics whereas the base must have good resistance to wear for the cooperation with the spindle head and must enable easy bonding with the interface 105.

In the example shown, the deformable ring 117 is a simple commercially available O-ring, for example in Nitrile.

The end surface 113 of the support 104 is part-spherical with a radius of curvature of the order of 70 mm.

When the base 130 is not loaded, i.e. in the absence of external loads, the surface 132 of the flange 131 which, as indicated hereinabove, is flush with the surface 113 is conformed like a truncated cone the smaller diameter whereof corresponds to the largest diameter of the surface 113, the inclination (angle at the apex) of the surface 131 being given by the tangent to the surface 113 in the area of junction with the surface 132.

Thanks to the flange 131, the area of contact between the interface 105 and the rest of the tool, in this instance the base 130, is particularly large since it is formed both by the surface 113 and by the surface 132.

This ensures a uniform distribution of the pressure exerted on the surface to be worked, such as the surface 2 of the lens 3.

Figure 2:
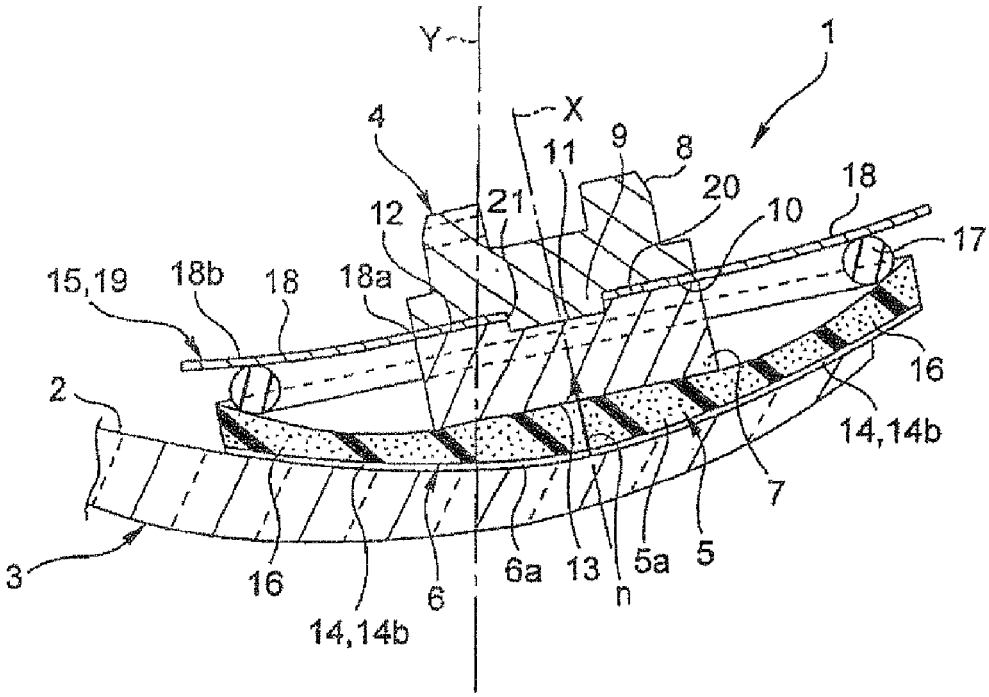
Fig.2 Prior Art
Figure 3:
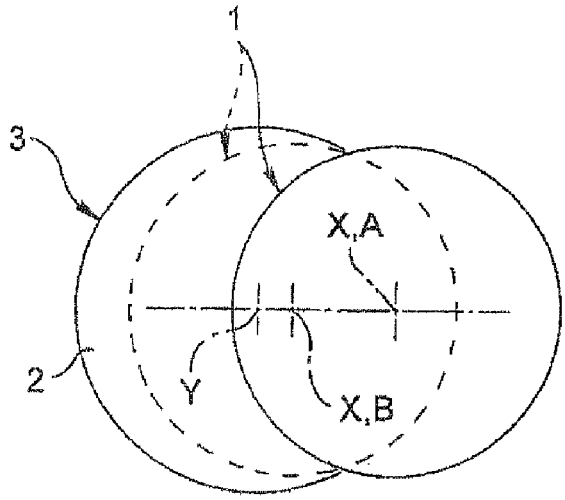
Fig.3 Prior Art

In particular, the risk of the sharp edge of the end surface 13 marking the surface to be worked is avoided, as with the prior art tool shown in FIGS. 1 to 3.

More generally this enables the tool 101 to effect surfacing operations having a particularly high quality appearance.

Moreover, the fact of having both the surface 113 and the surface 132 available facilitates the bonding of the interface 105 with the rigid support 104.

Figure 8:
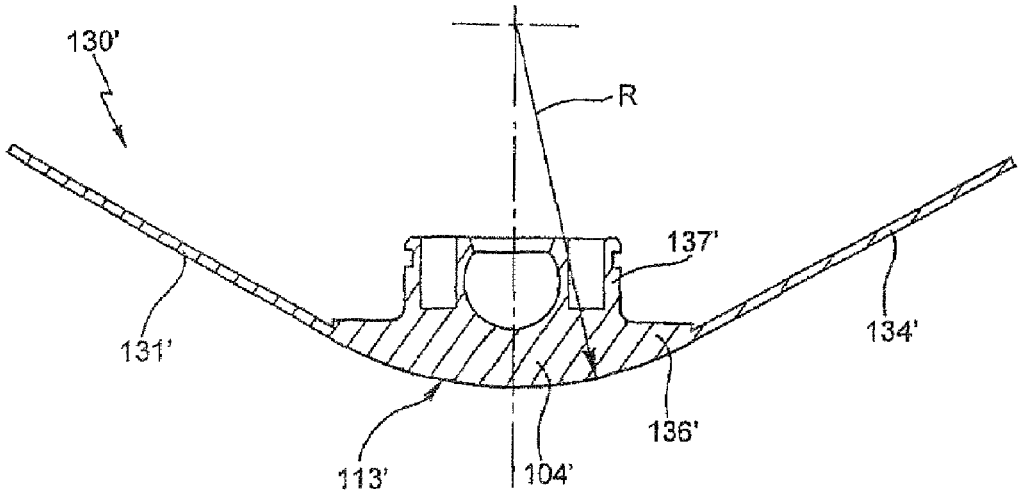
FIG. 8 is a view in elevation section of a variant of the base.

A variant 130' of the base 130 is described next with reference to FIG. 8. The same reference numbers have been employed for similar components, but with the suffix '.

The base 130' is arranged like the base 130 but the radius of curvature R of the end surface 113' is much smaller, of the order of 30 mm.

The tool that includes the base 130' is particularly suitable for very highly cambered surfaces.

Figure 9:
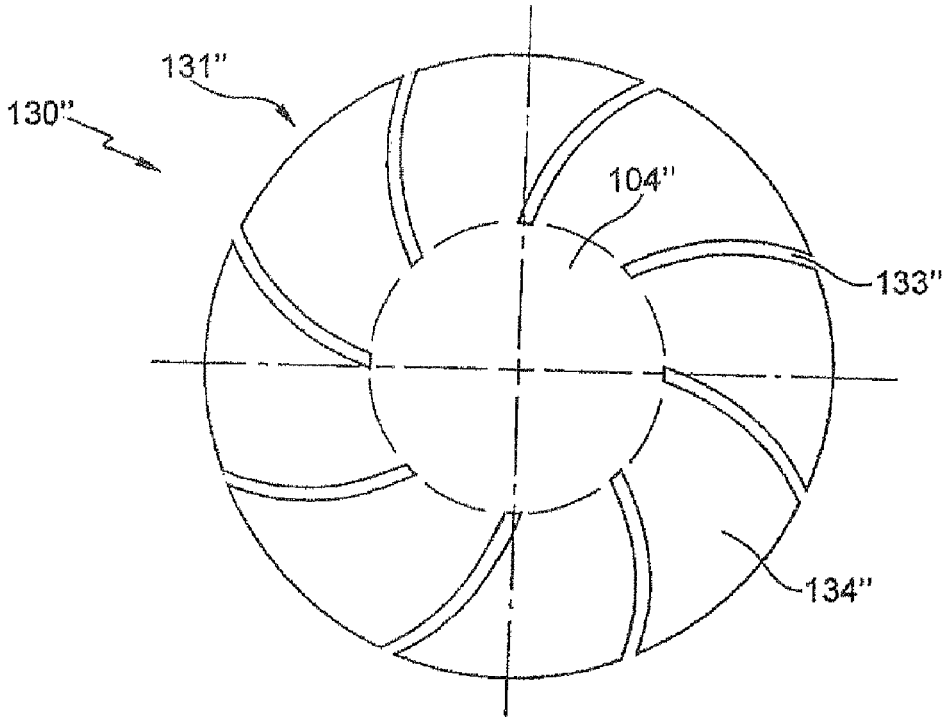
FIGS. 9 and 10 are bottom views showing other variants of the base that the tool according to the invention includes.
Figure 10:
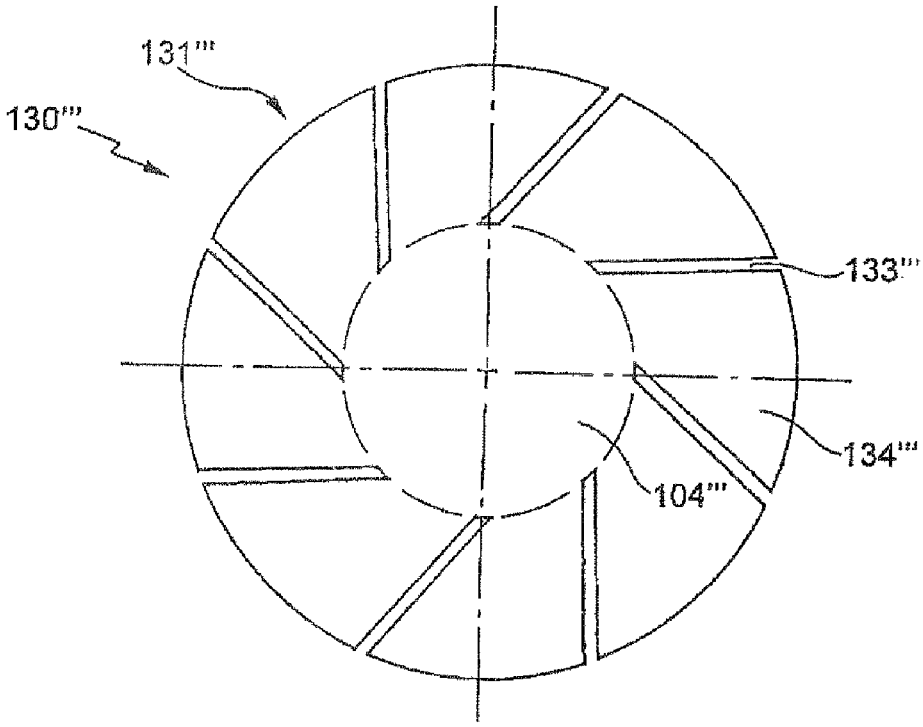

For the variants 130" and 130''' of the base 130 shown in FIGS. 9 and 10, respectively, the same reference numbers have been used as above but respectively with the suffix " and the suffix '''.

Generally speaking, the bases 130" and 130''' are arranged like the base 130 or the base 130' but their flanges, 131" and 131''', respectively, comprise eight petals 134' and 134''', respectively, these petals being delimited by slots 133' and 133''', respectively, that are not oriented radially.

More precisely, the slots 133" are curved whereas the slots 133''' are rectilinear but disposed in directions that are not radial.

In variants that are not shown, the base of the tool according to the invention has a number of petals other than eight or twelve, for example six or sixteen, and the slots delimiting the petals have different shapes, for example with undulations.

In other variants that are not shown of the base 130, the flange 131 is replaced by a flexible flange that is not subdivided into petals.

In further variants that are not shown, the support 104 is a different shape, for example in two portions forming jaws as in the prior art tool shown in FIGS. 1 to 3.

In further variants of the tool according to the invention, the components other than the base are arranged differently, for example as shown in FIGS. 1 to 3.

Numerous other variants are possible as a function of circumstances, and in this connection it is pointed out that the invention is not limited to the examples described and shown.

The invention claimed is:

1. Tool for surfacing an optical surface, including:

a rigid support (104; 104'; 104"; 104''') having a transverse end surface (113; 113');

an elastically compressible interface (105) that is pressed against and covers said end surface (113; 113');

a flexible pad (106) adapted to be pressed against the optical surface that is pressed against and covers at least part of the interface (105) on the side opposite and in line with said end surface (113; 113'), said pad (106) having a central portion that is located in line with said end surface (113; 113') and a peripheral portion that is located transversely beyond said end surface (113; 113'); and spring return means (115) connecting the peripheral portion to the support (104; 104', 104"; 104'''), the combination of said peripheral portion and the return means (115) forming means for stabilizing the tool during surfacing, said tool being adapted to effect surfacing essentially in the region of said central portion;

characterized in that said rigid support (104; 104'; 104"; 104''') is part of a base (130; 130'; 130"; 130''') including a flexible flange (131; 131'; 131"; 131''') surrounding said support (104; 104'; 104"; 104'''), said elastically compressible interface (105) being pressed against and covering an end surface (132) of said flange situated on the same side as said transverse end surface (113; 113').

2. Tool according to claim 1, characterized in that said end surface (132) of the flange (131; 131'; 131"; 131''') is flush with said end surface (113; 113') of said support (104; 104'; 104"; 104''').

3. Tool according to claim 1, characterized in that said flange (131; 131'; 131"; 131''') is subdivided into petals (134; 134'; 134"; 134''').

4. Tool according to claim 3, characterized in that said petals (134; 134') are subdivided by rectilinear slots (133) oriented radially.

5. Tool according to claim 3, characterized in that said petals (134''') are subdivided by rectilinear slots (133''') having an orientation other than radial.

6. Tool according to claim 3, characterized in that said petals (134") are subdivided by curved slots (133").

7. Tool according to claim 1, characterized in that said rigid support (104) includes a cavity (140) to receive the head of a surfacing machine spindle.

8. Tool according to claim 7, characterized in that said cavity (140) has a spherical portion (140) bordered by an annular rib (142)

9. Tool according to claim 1, characterized in that the rigid support (104) has in a lateral wall a groove (147) to receive a rib (148) of said spring return means (115).

10. Tool according to claim 1, characterized in that said spring return means (115) is formed by a star-shaped part (119) each branch (118) whereof has on the side of its free end and on the side that faces toward said base (130; 130'; 130"; 130'") a cusp (145).

11. Tool according to claim 10, characterized in that each of said cusps (145) has, on an external side, a surface (146) conformed as a portion of a torus, wherein said star-shaped part is adapted to receive a deformable ring (117).

12. Tool according to claim 1, characterized in that said base (130; 130'; 130"; 130'") is molded in one piece in plastic material.

13. Tool according to claim 1, characterized in that said spring return means (115) is formed by a star-shaped part (119) molded in one piece in plastic material.

14. Tool according to claim 1, characterized in that said base (130; 130'; 130"; 130'") is molded in one piece in plastic material; in that said spring return means (115) is formed by a star-shaped part (119) molded in one piece in plastic material; and in that the plastic material in which said base is made is different from the plastic material in which said star-shaped part (119) is made.

15. Tool according to claim 2, characterized in that said flange (131; 131'; 131"; 131'") is subdivided into petals (134; 134'; 134"; 134'").

16. Tool according to claim 2, characterized in that the rigid support (104) has in a lateral wall a groove (147) to receive a rib (148) of said spring return means (115).

17. Tool according to claim 2, characterized in that said spring return means (115) is formed by a star-shaped part (119) each branch (118) whereof has on the side of its free end and on the side that faces toward said base (130; 130'; 130"; 130'") a cusp (145).

18. Tool according to claim 2, characterized in that said base (130; 130'; 130"; 130'") is molded in one piece in plastic material.

19. Tool according to claim 2, characterized in that said spring return means (115) is formed by a star-shaped part (119) molded in one piece in plastic material.

20. Tool according to claim 2, characterized in that said base (130; 130'; 130 "; 130'") is molded in one piece in plastic material; in that said sprinq return means (115) is formed by a star-shaped part (119) molded in one piece in plastic material; and in that the plastic material in which said base is made is different from the plastic material in which said star-shaped part (119) is made.

* * * * *